US008899578B2

(12) United States Patent
Tomatsu

(10) Patent No.: US 8,899,578 B2
(45) Date of Patent: Dec. 2, 2014

(54) IMAGE FORMING APPARATUS

(75) Inventor: Yoshiya Tomatsu, Kasugai (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 13/416,543

(22) Filed: Mar. 9, 2012

(65) Prior Publication Data

US 2012/0228816 A1 Sep. 13, 2012

(30) Foreign Application Priority Data

Mar. 11, 2011 (JP) ..... 2011-054668

(51) Int. Cl.

| | |
|---|---|
| ***B65H 29/00*** | (2006.01) |
| ***B65H 29/12*** | (2006.01) |
| ***B41J 3/60*** | (2006.01) |
| ***B41J 11/00*** | (2006.01) |
| ***B65H 85/00*** | (2006.01) |
| ***B65H 1/26*** | (2006.01) |
| ***B65H 5/06*** | (2006.01) |
| ***G03G 21/16*** | (2006.01) |

(52) U.S. Cl.

CPC ..... *B65H 29/125* (2013.01); *B41J 3/60* (2013.01); *B41J 11/006* (2013.01); *B65H 85/00* (2013.01); *B65H 1/266* (2013.01); *B65H 5/062* (2013.01); *G03G 21/1633* (2013.01); *G03G 21/1638* (2013.01); *G03G 21/1695* (2013.01); *B65H 2404/1422* (2013.01); *B65H 2404/143* (2013.01); *B65H 2404/144* (2013.01); *B65H 2404/1521* (2013.01); *B65H 2404/1522* (2013.01); *B65H 2601/11* (2013.01); *B65H 2801/06* (2013.01); *B65H 2801/12* (2013.01); *B65H 2402/441* (2013.01); *B65H 2404/611* (2013.01); *B65H 2405/313* (2013.01)

USPC ..... 271/186

(58) Field of Classification Search

USPC ..... 271/65, 185, 186, 225, 291, 301, 162

See application file for complete search history.

(56) References Cited

U.S. PATENT DOCUMENTS 4,660,963 A * 4/1987 Stemmle ..... 355/24
4,884,110 A * 11/1989 Tsurubuchi et al. ..... 399/402

(Continued)

FOREIGN PATENT DOCUMENTS

JP S62-056229 A 3/1987
JP 02-052367 2/1990

(Continued)

OTHER PUBLICATIONS

Jan. 21, 2014 Office Action issued in Japanese Patent Application No. 2011-054668.

(Continued)

*Primary Examiner* — Thomas Morrison
(74) *Attorney, Agent, or Firm* — Banner & Witcoff, Ltd.

(57) ABSTRACT

An image forming apparatus which may include an apparatus body, a feed tray, an image forming unit, an eject section and a first transport mechanism forming a first transport path extending between the feed tray and the eject section via the image forming unit. The image forming apparatus may also include a second transport mechanism forming a second transport path that extends between a branch position located downstream of the image forming unit on the first transport path and a merge position located upstream of the image forming unit on the first transport path. The second transport mechanism may be configured to transport the recording medium along the second transport path and reintroduce the recording medium to the first transport path from the merge position. At least one part of the second transport mechanism and the feed tray may be incorporated in a detachable unit.

19 Claims, 8 Drawing Sheets

(56) References Cited

U.S. PATENT DOCUMENTS

| | | | | |
|---|---|---|---|---|
| 4,928,150 | A * | 5/1990 | Hatta | 399/401 |
| 5,089,858 | A * | 2/1992 | Ohno et al. | 399/402 |
| 5,225,881 | A | 7/1993 | Goto et al. | |
| 6,185,381 | B1 * | 2/2001 | Nakahara et al. | 399/21 |
| 2002/0074720 | A1 | 6/2002 | Kato et al. | |
| 2007/0172255 | A1 | 7/2007 | Nanno et al. | |
| 2009/0087238 | A1 * | 4/2009 | Furuyama | 399/389 |
| 2011/0024965 | A1 * | 2/2011 | Tokoro | 271/3.14 |
| 2011/0210501 | A1 * | 9/2011 | Shiokawa et al. | 271/241 |

FOREIGN PATENT DOCUMENTS

| | | | |
|---|---|---|---|
| JP | 4-164727 | * | 6/1992 |
| JP | H07-234559 | A | 9/1995 |
| JP | 08-015931 | | 1/1996 |
| JP | H08-108952 | A | 4/1996 |
| JP | H11-246132 | A | 9/1999 |
| JP | 2002-179282 | A | 6/2002 |
| JP | 2004-070078 | A | 3/2004 |
| JP | 2005-114979 | A | 4/2005 |
| JP | 2007-197156 | | 8/2007 |
| JP | 2009-179411 | | 8/2009 |
| JP | 2010-189092 | A | 9/2010 |

OTHER PUBLICATIONS

Mar. 3, 2014 Office Action issued in Chinese Patent Application No. 201210020549.8.

Aug. 19, 2014—(CN) Notification of Second Office Action—App 201210020549.8—Eng Tran.

* cited by examiner

IMAGE FORMING APPARATUS

CROSS REFERENCE TO RELATED APPLICATION

This application claims priority from Japanese Patent Application No. 2011-054668, filed on Mar. 11, 2011, the entire subject matter of which is incorporated herein by reference.

TECHNICAL FIELD

An aspect of the present invention relates to an image forming apparatus.

BACKGROUND

A known image forming apparatus can form an image on both sides of a recording medium. The image forming apparatus has a built-in transport mechanism that transports the recording medium. This transport mechanism forms a first transport path and a second transport path.

In the duplex printing function, first, a recording medium drawn out from a feed tray is transported along the first transport path. As the recording medium passes through an image forming position on the first transport path, an image is formed on one side of the recording medium.

Thereafter, the recording medium continues to be transported on the first transport path, and when the rear end of the recording medium reaches a position where the rear end passes through the branch position from the first transport path to the second transport path, the recording medium is switched back so that the recording medium is introduced to the second transport path.

Then, the recording medium transported on the second transport path is introduced to the first transport path again at a position located upstream of the above-mentioned image forming position on the first transport path. At this time, the surface and back of the recording medium are reversed. Thus, as the recording medium is transported along the first transport path and passes through the above-mentioned image forming position again, an image is formed on the other side of the recording medium. In the image forming apparatus which has a duplex printing unit, the duplex printing unit is provided at the position of the lowermost part of the image forming apparatus. This duplex printing unit forms the second transport path mentioned above. The feed tray is located above the duplex printing unit.

In the image forming apparatus according to the related art as described above, when the recording medium transported along the second transport path is jammed (when a jam occurs) inside the duplex printing unit, the user first detaches the feed tray from the main body, and then removes the jammed recording medium by sticking a hand into the space where the feed tray was previously accommodated.

However, generally, the space where the feed tray was previously accommodated is often very narrow. It is difficult to remove the recording medium positioned in between a transport roller and a pinch roller that are provided in the duplex printing unit.

SUMMARY

Illustrative aspects of the disclosure provide an image reading apparatus which performs an operation for removing a recording medium easily, even when the recording medium is jammed within a transport path prepared for duplex printing.

Aspects of the disclosure may relate to an image forming apparatus which may include an apparatus body, a feed tray configured to accommodate a recording medium in a form of a sheet, and an image forming unit configured to form an image on the recording medium fed from the feed tray. The image forming apparatus may also include an eject section configured to eject the recording medium on which the image has been formed by the image forming unit and a first transport mechanism forming a first transport path extending between the feed tray and the eject section via the image forming unit. The first transport mechanism may be configured to transport the recording medium along the first transport path. The image forming apparatus may also include a second transport mechanism forming a second transport path that extends between a branch position located downstream of the image forming unit on the first transport path and a merge position located upstream of the image forming unit on the first transport path and that branches off from the first transport path at the branch position and merges with the first transport path at the merge position. The second transport mechanism may be configured to transport the recording medium along the second transport path and reintroduce the recording medium to the first transport path from the merge position. The image forming apparatus may also include a plurality of rollers configured to transport the recording medium along the second transport path. At least one part of the second transport mechanism and the feed tray may be incorporated in a detachable unit that is configured to be attached to and detached from the apparatus body, and when the detachable unit is detached from the apparatus body, at least one roller of the plurality of rollers is detached from the apparatus body together with the detachable unit.

Additional aspects of the disclosure may relate to an image forming apparatus which includes an apparatus body, a feed tray configured to accommodate a recording medium and an image forming unit configured to form an image on the recording medium fed from the feed tray. The image forming apparatus may also include an eject section configured to eject the recording medium on which the image has been formed by the image forming unit and a first transport mechanism forming a first transport path extending between the feed tray and the eject section via the image forming unit. The first transport mechanism may be configured to transport the recording medium along the first transport path. The image forming apparatus may also include a second transport mechanism forming a second transport path that extends between a branch position located downstream of the image forming unit on the first transport path and a merge position located upstream of the image forming unit on the first transport path and that branches off from the first transport path at the branch position and merges with the first transport path at the merge position. The second transport mechanism may be configured to transport the recording medium along the second transport path and reintroduce the recording medium to the first transport path from the merge position. The image forming apparatus may also include a plurality of rollers configured to transport the recording medium along the second transport path. The second transport mechanism may include an intermediate section that is provided directly above the feed tray. At least a part of the intermediate section of the second transport mechanism and the feed tray may be incorporated in a detachable unit that is configured to be attached to and detached from the apparatus body, and when the detachable unit is detached from the apparatus body, at least a first roller of the plurality of rollers is detached from the apparatus body together with the detachable unit.

DETAILED DESCRIPTION

Figure 1:
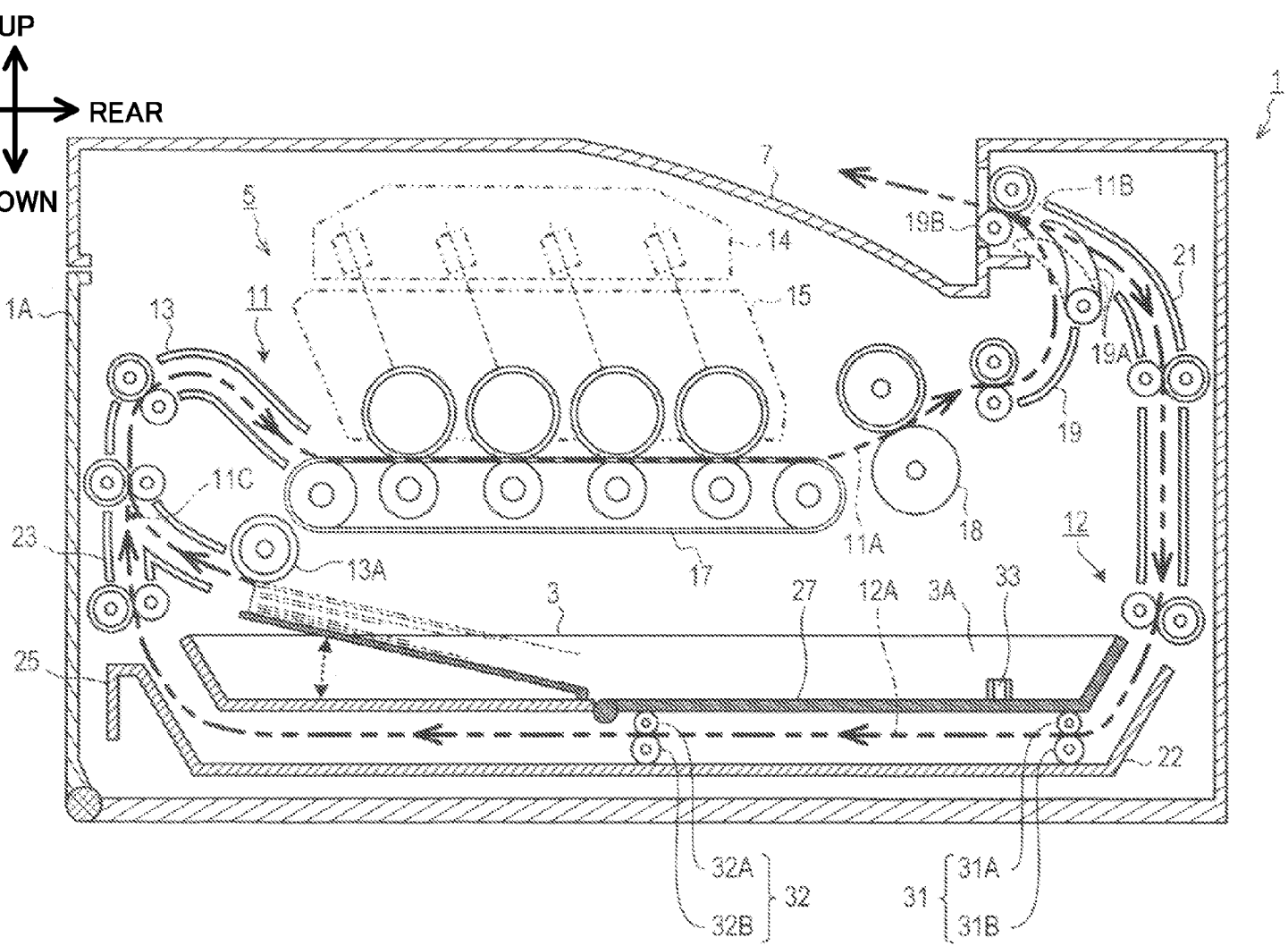
FIG. 1 is a longitudinal sectional view showing the internal structure of an image forming apparatus according to a first embodiment of the disclosure.

Illustrative embodiments of the present disclosure will be described by way of several examples. In the following description, in order to clearly describe the positional relationship of parts of an image forming apparatus the directions of up, down, left, right, front, and rear indicated in the drawings will be used.

As shown in FIG. 1, an image forming apparatus 1 includes a feed tray 3 in which a sheet-like recording medium is accommodated, an image forming section 5 that form an image on the recording medium fed from the feed tray 3, and an eject section 7 to which the recording medium on which an image has been formed by the image forming section 5 is ejected. The image forming apparatus 1 also includes a first transport mechanism 11 that transports the recording medium along a first transport path 11A, and a second transport mechanism 12 that transport the recording medium along a second transport path 12A.

The first transport path 11A is a path between the feed tray 3 and the eject section 7 via the image forming unit (e.g., a path that extends from the feed tray 3 to the eject section 7 via the image forming section 5). The second transport path 12A is a path that extends between a branch position 11B located downstream of the image forming section 5 on the first transport path 11A and a merge position 11C located upstream of the image forming section 5 on the first transport path 11A. Further, the second transport path 12A is a path that branches off from the first transport path 11A at a branch position 11B located downstream of the image forming section 5 on the first transport path 11A, and merges with the first transport path 11A at a merge position 11C located upstream of the image forming section 5 on the first transport path 11A.

A part of the first transport mechanism 11 is formed by a movable mechanism and a stationary mechanism dedicated to the first transport mechanism 11, and another part is formed by a movable mechanism and a stationary mechanism that are shared with the image forming section 5.

Specifically, a feed mechanism 13 is provided at a position toward the front of the image forming apparatus 1 and above the feed tray 3. The feed mechanism 13 forms a part of the first transport mechanism 11. The feed mechanism 13 includes a group of driving rollers (e.g., a pickup roller 13A), a group of driven rollers that pinch the recording medium with the driving rollers and rotate following the driving rollers or the recording medium, and the like.

The feed mechanism 13 also includes a guide section that guides the recording medium transported by the group of driving rollers and the group of driven rollers, along a predetermined transport direction, and the like. A power transmission mechanism (e.g., a gear mechanism or a cam mechanism) that transmits power from a power source (e.g., a motor) (not shown) to the driving rollers provided in the feed mechanism 13, and the like are also attached. Through the feed mechanism 13 as described above, the recording medium is transported one by one from the feed tray 3 to the image forming section 5 along the first transport path 11A.

The image forming section 5 forms an image on the recording medium by the electrophotographic technique, and includes a scanner unit 14, a process cartridge 15, a belt unit 17, a fixing device 18, and the like. In the image forming section 5, the process cartridge 15, the belt unit 17, the fixing device 18, and the like form a part of the first transport mechanism 11.

The scanner unit 14 is a device that irradiates each photosensitive member provided in the process cartridge 15 with laser light to thereby form an electrostatic latent image on the photosensitive member.

The process cartridge 15 includes four sets of image forming mechanisms that form images of different colors (yellow, magenta, cyan, and black). These four sets of image forming mechanisms are arranged in series. The image forming mechanisms each include a photosensitive body, a developing mechanism for developing an electrostatic latent image formed on the photosensitive member, and the like.

The belt unit 17 has a transport belt that is driven to circulate. This transport belt is located at a position that contacts each photosensitive body provided in the process cartridge 15. The recording medium fed from the feed mechanism 13 is introduced between the process cartridge 15 and the belt unit 17, and is transported along the first transport path 11A by the transport belt, while being pinched between the process cartridge 15 and the belt unit 17.

At this time, the electrostatic latent image written onto each photosensitive member in the process cartridge 15 by the scanner unit 14 is developed by the corresponding developing mechanism in the process cartridge 15 into a toner image. Then, the toner image is transferred to the recording medium transported between the process cartridge 15 and the belt unit 17, and the resulting recording medium is transported to the fixing device 18.

The fixing device 18 is a device that pinches the recording medium to which the toner image has been transferred between a pair of rollers to apply heat and pressure to the recording medium, thereby fixing the toner image to the recording medium. The recording medium having passed through the fixing device 18 is transported along the first transport path 11A to an eject mechanism 19.

The eject mechanism 19 also forms a part of the first transport mechanism 11. The eject mechanism 19 includes a group of driving rollers (e.g., an eject roller 19B), a group of driven rollers that pinch the recording medium with the driving rollers and rotate following the driving rollers or the recording medium, and the like. The eject mechanism 19 also includes a guide section that guides the recording medium transported by the group of driving rollers and the group of driven rollers, along a predetermined transport direction, and the like.

In the case of printing only on one side of the recording medium, the recording medium transported by the eject mechanism 19 is transported along the first transport path 11A and ejected to the eject section 7. Even in the case of printing on both sides of the recording medium, the recording medium transported by the eject mechanism 19 is transported along the first transport path 11A, until the rear end in the transport direction of the recording medium reaches the branch position 11B.

Then, in the case of printing on both sides of the recording medium, when the rear end in the transport direction of the recording medium transported by the eject mechanism 19 reaches the branch position 11B, the recording medium is subsequently introduced to the second transport path 12A.

Specifically, in the eject mechanism 19, a movable guide 19A is provided near the branch position 11B. When the rear end in the transport direction of the recording medium reaches the branch position 11B, the movable guide 19A is displaced from the position indicated by a solid line in FIG. 1 to the position indicated by a broken line. Then, the driving rollers (e.g., the eject roller 19B) of the eject mechanism 19, which are previously rotated in the forward direction until the rear end in the transport direction of the recording medium reaches the branch position 11B, are rotated in the reverse direction. Thus, the recording medium is introduced to the second transport path 12A, in such a way that its rear end in the transport direction within the first transport path 11A becomes the front end in the transport direction within the second transport path 12A.

The second transport mechanism 12 is made up of three portions, a branch section 21, an intermediate section 22, and a merge section 23, which are arranged in this order from the upstream side in the transport direction within the second transport path 12A. The branch section 21 is a portion that branches off from the first transport path 11A at the rear of the image forming apparatus 1 and extends mainly downwards. The intermediate section 22 is a portion that extends mainly forwards in parallel to the feed tray 3 from near the lower end of the branch section 21 at the bottom of the image forming apparatus 1. The merge section 23 is a portion that extends mainly upwards from near the front end of the intermediate section 22 at the front of the image forming apparatus 1 and merges with the first transport path 11A.

The branch section 21, the intermediate section 22, and the merge section 23 are each provided with a group of driving rollers, a group of driven rollers that pinch the recording medium with the driving rollers and rotate following the driving rollers or the recording medium, and the like. The branch section 21, the intermediate section 22, and the merge section 23 also each include a guide section that guides the recording medium transported by the group of driving rollers and the group of driven rollers, along a predetermined transport direction, and the like.

By the second transport mechanism 12 including the branch section 21, the intermediate section 22, and the merge section 23, the recording medium is transported along the second transport path 12A from the branch position 11B to the merge position 11C. Then, upon reaching the merge position 11C, the recording medium is subsequently introduced to the first transport path 11A from the merge position 11C.

The front and back sides of the recording medium introduced to the first transport path 11A have been reversed from when the recording medium is previously transported along the first transport path 11A. Thus, the image forming section 5 form an image on the side opposite to the side on which an image is previously formed. It should be noted that the recording medium with the image formed on both sides in this way is transported along the first transport path 11A and ejected to the eject section 7 by the eject mechanism 19.

In the image forming apparatus 1, the intermediate section 22 that forms a part of the second transport mechanism 12 can be attached to and detached from the main body of the image forming apparatus 1, together with the feed tray 3. More specifically, the feed tray 3 and the intermediate section 22 may be incorporated in a detachable unit 25 that can be attached to and detached from the body of the image forming apparatus 1.

Figure 2A:
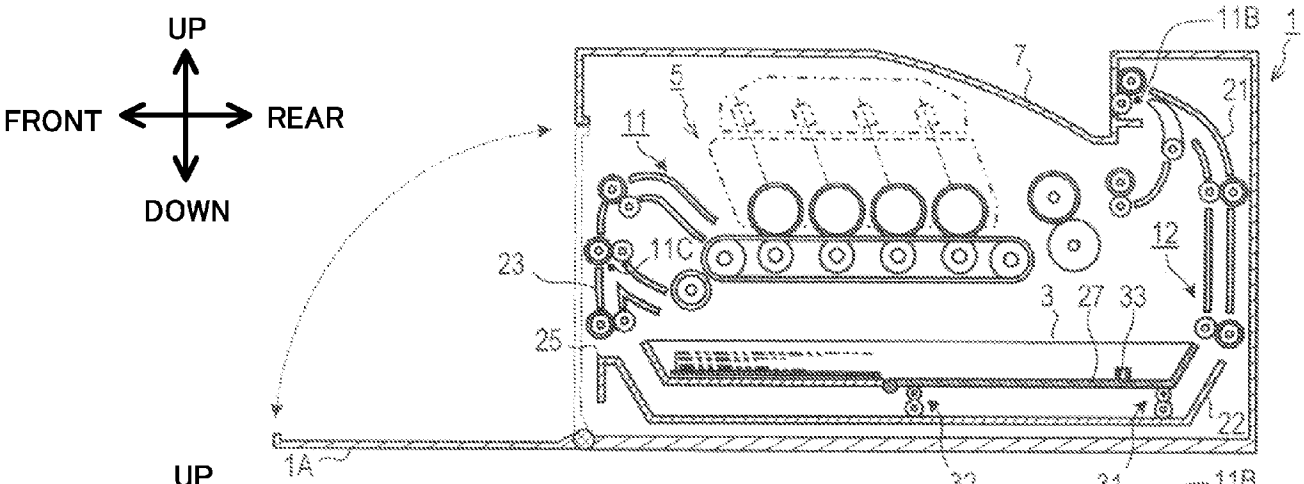
FIGS. 2A and 2B are a longitudinal sectional view showing a state in which a front panel of the image forming apparatus illustrated in FIG. 1 is opened, and a longitudinal sectional view showing a state in which a detachable unit of the image forming apparatus illustrated in FIG. 1 is detached, respectively.
Figure 2B:
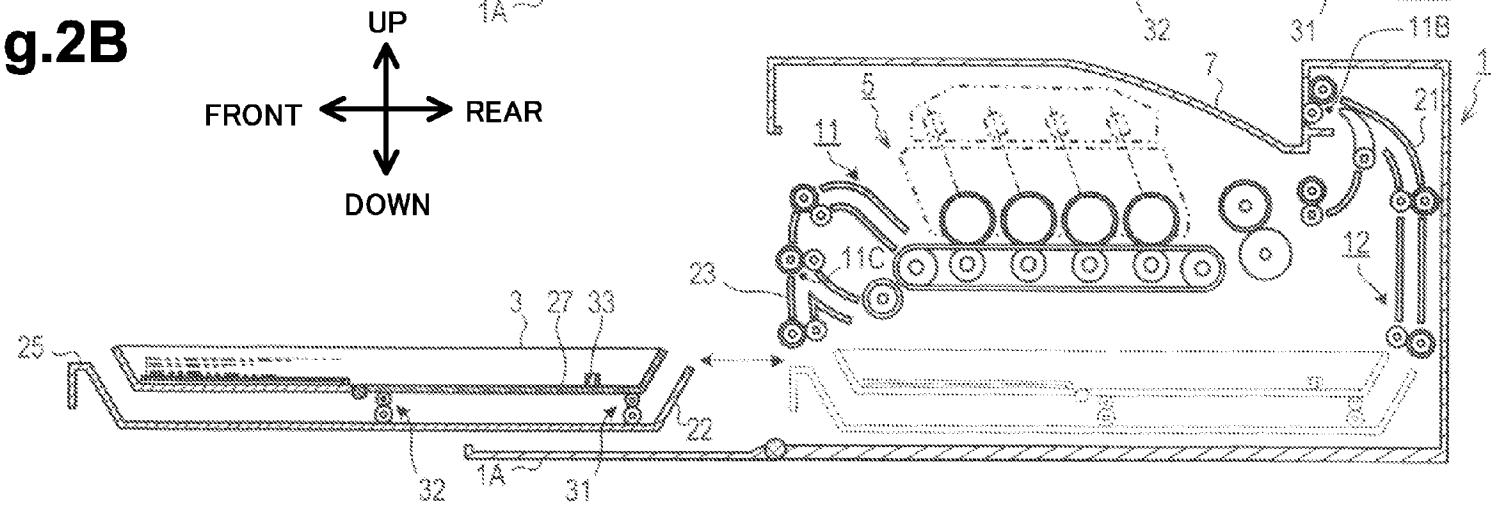

Therefore, when a front panel 1A on the front of the image forming apparatus 1 is opened as shown in FIG. 2A, and the detachable unit 25 is pulled out as shown in FIG. 2B, both the feed tray 3 and the intermediate section 22 can be taken out of the apparatus. It is noted that according to aspects of the disclosure, the feed mechanism 13 may also be incorporated in the detachable unit so that the feed mechanism 13 can also be taken out of the apparatus.

That is, among the branch section 21, the intermediate section 22, and the merge section 23 that form the second transport mechanism 12, the intermediate section 22 can be detached from the main body of the image forming apparatus 1 while leaving the branch section 21 and the merge section 23 as they are on the main body side of the image forming apparatus 1.

Figure 3A:
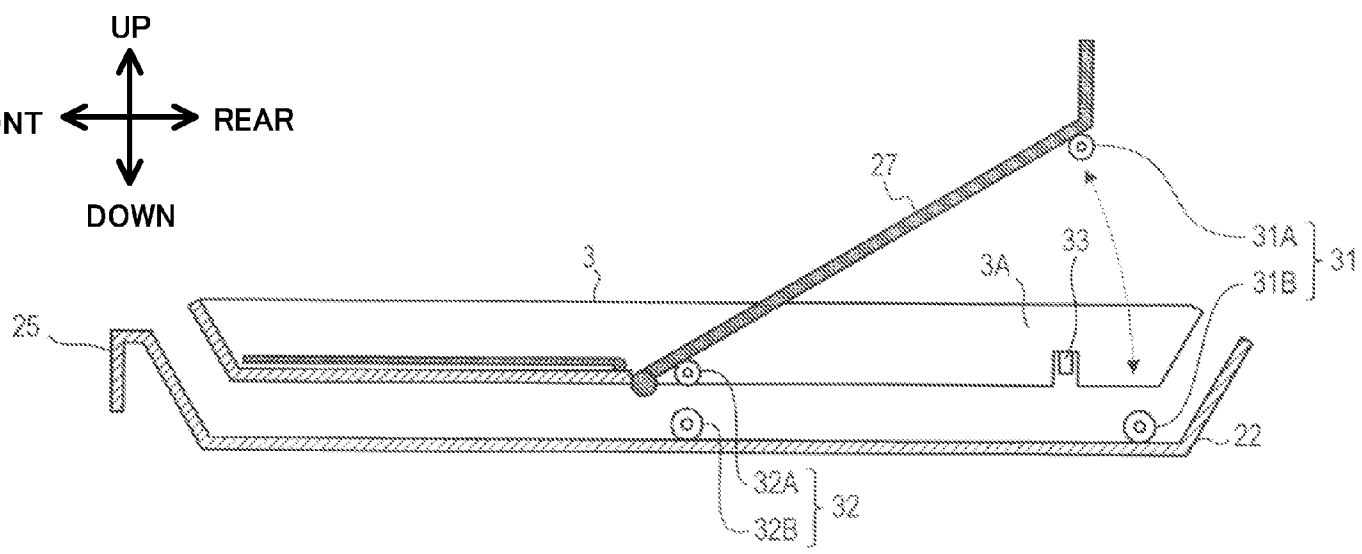
FIGS. 3A and 3B are a longitudinal sectional view showing a state in which a transport path is opened in the detachable unit of the image forming apparatus illustrated in FIG. 1, and a perspective view showing a lock mechanism provided in the detachable unit of the image forming apparatus illustrated as the first embodiment, respectively.

The recording medium accommodated in the feed tray 3 is placed on the upper surface of a support member 27 provided in the feed tray 3. As shown in FIG. 3A, the support member 27 is pivotable about its front end side as the pivot axis in such a way that its rear end side moves up and down.

When the support member 27 is pivoted upwards, in each of two roller pairs 31 and 32 provided in the intermediate section 22, one roller 31A, 32A (driven roller 31A, 32A) pivots together with the support member 27, and separates from the other roller 31B, 32B (driving roller 31B, 32B).

Figure 3B:
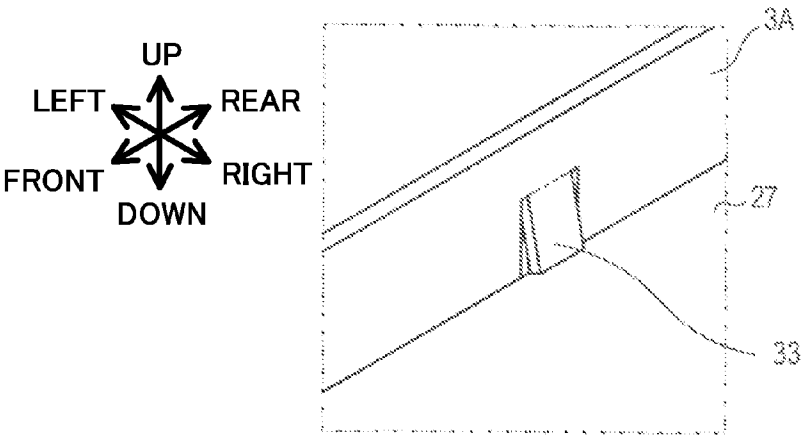

In the detachable unit 25, when the support member 27 is pivoted downwards and returned to the initial position shown in FIG. 1, as shown in FIG. 3B, an elastic engaging member 33 formed in a side wall portion 3A of the feed tray 3 is caught on the top of the support member 27. Therefore, unless an operation to release the locking made by the elastic engagement member 33 is intentionally performed, the support member 27 does not pivot upwards from the initial position.

According to the image forming apparatus 1 configured as described above, the intermediate section 22 forming apart of the second transport mechanism 12 can be detached from the main body of the image forming apparatus 1. Consequently, when jamming of the recording medium occurs in the intermediate section 22, the jammed recording medium can be taken out of the main body of the image forming apparatus 1 together with the detachable unit 25 by detaching the detachable unit 25. Therefore, an operation for removing the jammed recording medium can be easily performed outside the main body of the image forming apparatus 1.

In particular, in the image forming apparatus 1 mentioned above, the paired rollers 31A and 31B of the roller pair 31 that pinch the recording medium when the recording medium is transported in the intermediate section 22 are both detached from the main body of the image forming apparatus 1, and the paired rollers 32A and 32B of the roller pair 32 are also both detached from the body of the image forming apparatus 1. Therefore, even if the recording medium is stuck on each of the roller pairs 31 and 32, an operation for removing such a recording medium can be easily performed outside the main body of the image forming apparatus 1.

In the image forming apparatus 1 mentioned above, a part of the second transport mechanism 12 is provided directly below the support member 27. Thus, the ceiling portion of the second transport path 12A in the intermediate section 22 can be demarcated by a single support member 27, without providing a member that demarcates the ceiling portion of the second transport path 12A in the intermediate section 22 separately from the support member 27.

Therefore, unlike a structure in which a member defining the ceiling portion of the second transport path 12A in the intermediate section 22 is left inside of the image forming apparatus 1 when the feed tray 3 is detached from the body of the image forming apparatus 1, the number of components that are stacked up in the vertical direction can be reduced, thereby achieving a corresponding reduction in the heightwise dimension of the image forming apparatus 1.

According to the image forming apparatus 1 mentioned above, by opening the support member 27, the second transport mechanism 12 can be exposed in the intermediate section 22. Thus, when the recording medium is jammed in the portion that can be exposed in this way, an operation for removing the jammed recording medium can be performed easily outside the body of the image forming apparatus 1.

Moreover, as the support member 27 is opened, the one roller 31A, 32A of paired rollers separates from the other roller 31B, 32B. Thus, when the recording medium is jammed in the portion where the roller pair 31, 32 is positioned, the jammed recording medium can be removed by simply opening the support member 27, without any additional operation for separating the roller pair 31, 32.

Further, according to the image forming apparatus 1 mentioned above, by closing the support member 27, the support member 27 can be locked by the elastic engaging member 33. Therefore, in the roller pair 31, 32, the paired rollers (the rollers 31A and 31B or the rollers 32A and 32B) can be brought into press contact with each other, and kept in that state. Thus, when the recording medium is transported, the recording medium can be transported while being appropriately pinched by the roller pair 31, 32.

Next, a second embodiment will be described. It should be noted that description of the embodiments from the second embodiment onwards will mainly focus on the differences from the first embodiment. Structural parts that are functionally equivalent to those of the first embodiment are denoted by the same reference numerals, and their detailed description is omitted.

Figure 4:
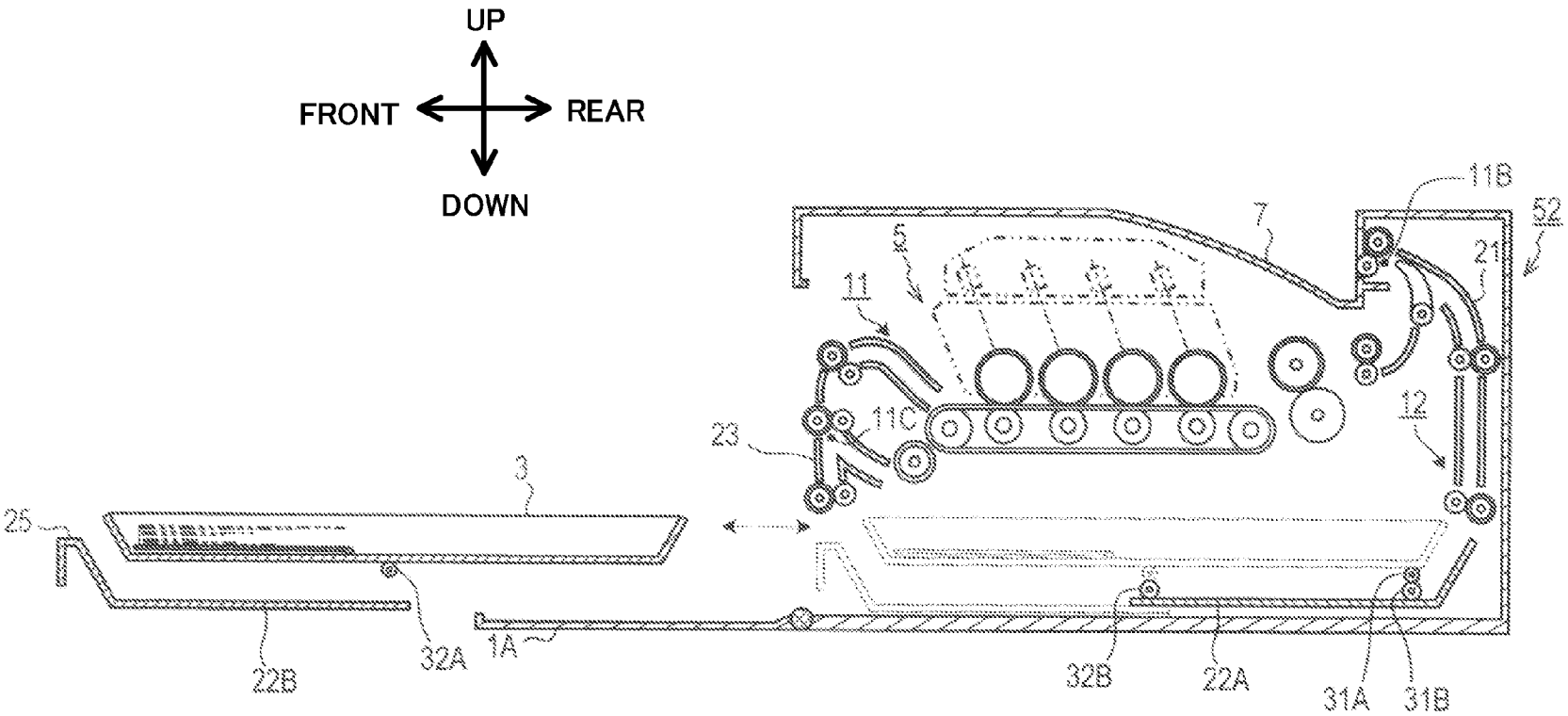
FIG. 4 is a longitudinal sectional view showing a state in which a detachable unit of an image forming apparatus according to a second embodiment of the disclosure is detached.

As shown in FIG. 4, in an image forming apparatus 52 according to the second embodiment of the disclosure, the portion corresponding to the intermediate section 22 illustrated in the first embodiment is made up of a first intermediate section 22A and a second intermediate section 22B.

Of the first intermediate section 22A and the second intermediate section 22B, the second intermediate section 22B is incorporated in the detachable unit 25, and is configured to be detached from the body of the image forming apparatus 52 together with the feed tray 3. On the other hand, the first intermediate section 22A is secured on the image forming apparatus 52 body side, so that the first intermediate section 22A is left on the image forming apparatus 52 main body side even when the detachable unit 25 is detached from the main body of the image forming apparatus 52.

Among the rollers 31A, 31B, 32A, and 32B arranged on the first intermediate section 22A and the second intermediate section 22B, the rollers 31A, 31B, and 32B are arranged on the image forming apparatus 52 main body side (first intermediate section 22A side), and the roller 32A is arranged on the detachable unit 25 side (second intermediate section 22B side).

In the case of the image forming apparatus 52, the pair of rollers 32A and 32B are separated by simply detaching the detachable unit 25. Therefore, in cases such as where the recording medium is stuck between the pair of rollers 32A and 32B, the recording medium can be removed easily by detaching the detachable unit 25, without any additional operation for separating the pair of rollers 32A and 32B.

Figures 5A, 5B:
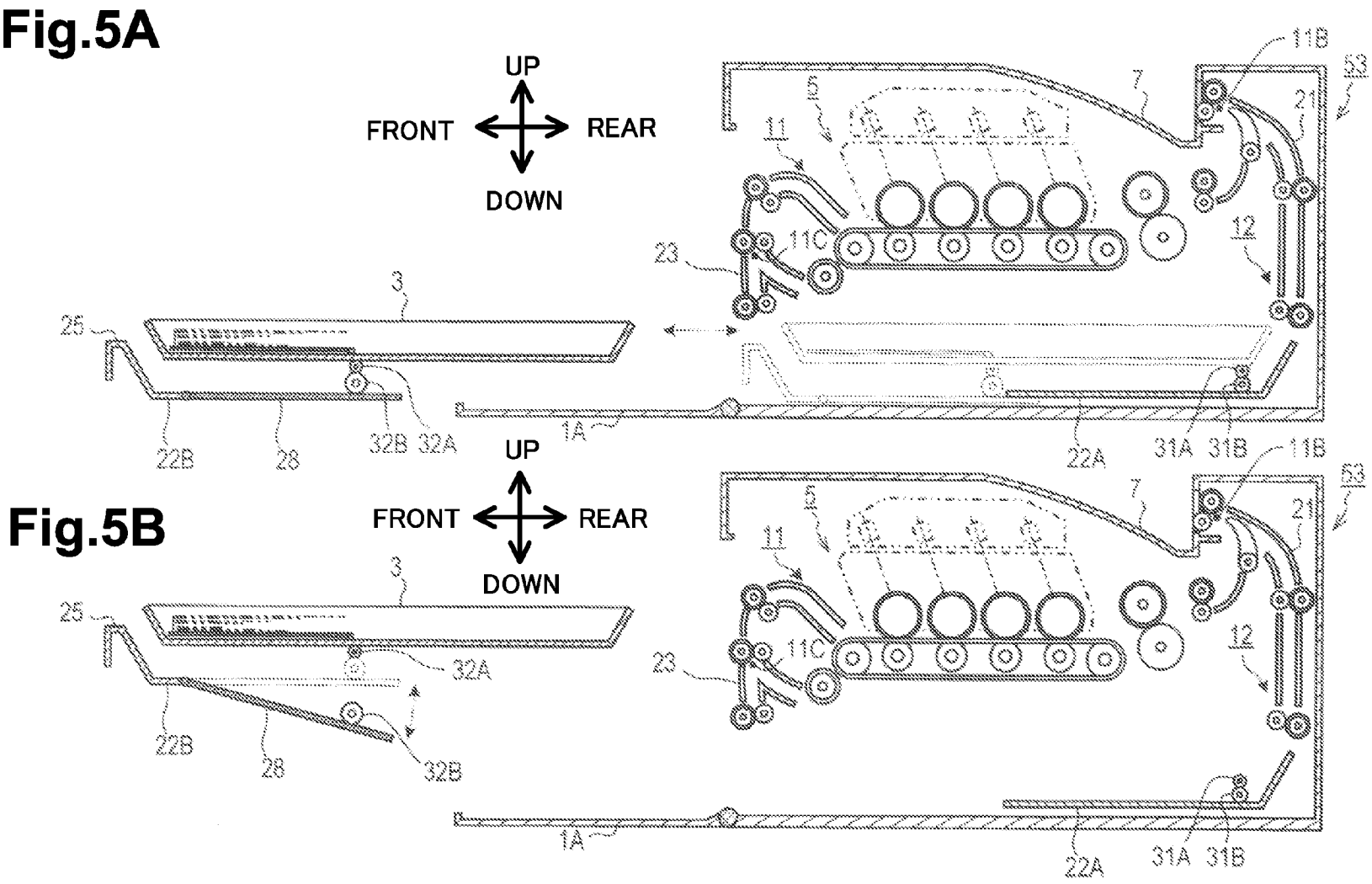
FIGS. 5A and 5B are a longitudinal sectional view showing a state in which a detachable unit of an image forming apparatus according to a third embodiment of the disclosure is detached, and a longitudinal sectional view showing a state in which a transport path of the image forming apparatus according to the third embodiment of the disclosure is opened, respectively.

Next, a third embodiment will be described. As shown in FIGS. 5A and 5B, in an image forming apparatus 53 illustrated as the third embodiment, as in the second embodiment, the portion corresponding to the intermediate section 22 illustrated in the first embodiment is made up of a first intermediate section 22A and a second intermediate section 22B.

Of the first intermediate section 22A and the second intermediate section 22B, the second intermediate section 22B is incorporated in the detachable unit 25, and is configured to be detached from the body of the image forming apparatus 53 together with the feed tray 3. On the other hand, the first intermediate section 22A is secured on the image forming apparatus 53 body side, so that the first intermediate section 22A is left on the image forming apparatus 53 body side even when the detachable unit 25 is detached from the body of the image forming apparatus 53.

Among the rollers 31A, 31B, 32A, and 32B arranged on the first intermediate section 22A and the second intermediate section 22B, the rollers 31A and 31B are arranged on the image forming apparatus 53 main body side (first intermediate section 22A side), and the rollers 32A and 32B are arranged on the detachable unit 25 side (second intermediate section 22B side).

That is, the third embodiment differs from the second embodiment in that the roller 32B is arranged on the detachable unit 25 side (second intermediate section 22B side). Moreover, unlike in the second embodiment, the second intermediate section 22B is provided with a movable section 28. When the movable section 28 is opened (see FIG. 5B), the pair of rollers 32A and 32B can be separated.

In the case of the image forming apparatus 53, the pair of rollers 32A and 32B are separated by simply opening the movable section 28. Therefore, in cases such as where the recording medium is stuck between the pair of rollers 32A and 32B, by detaching the detachable unit 25 and opening the movable section 28, the recording medium can be removed easily through an operation done outside the main body of the image forming apparatus 53.

Figures 6A, 6B:
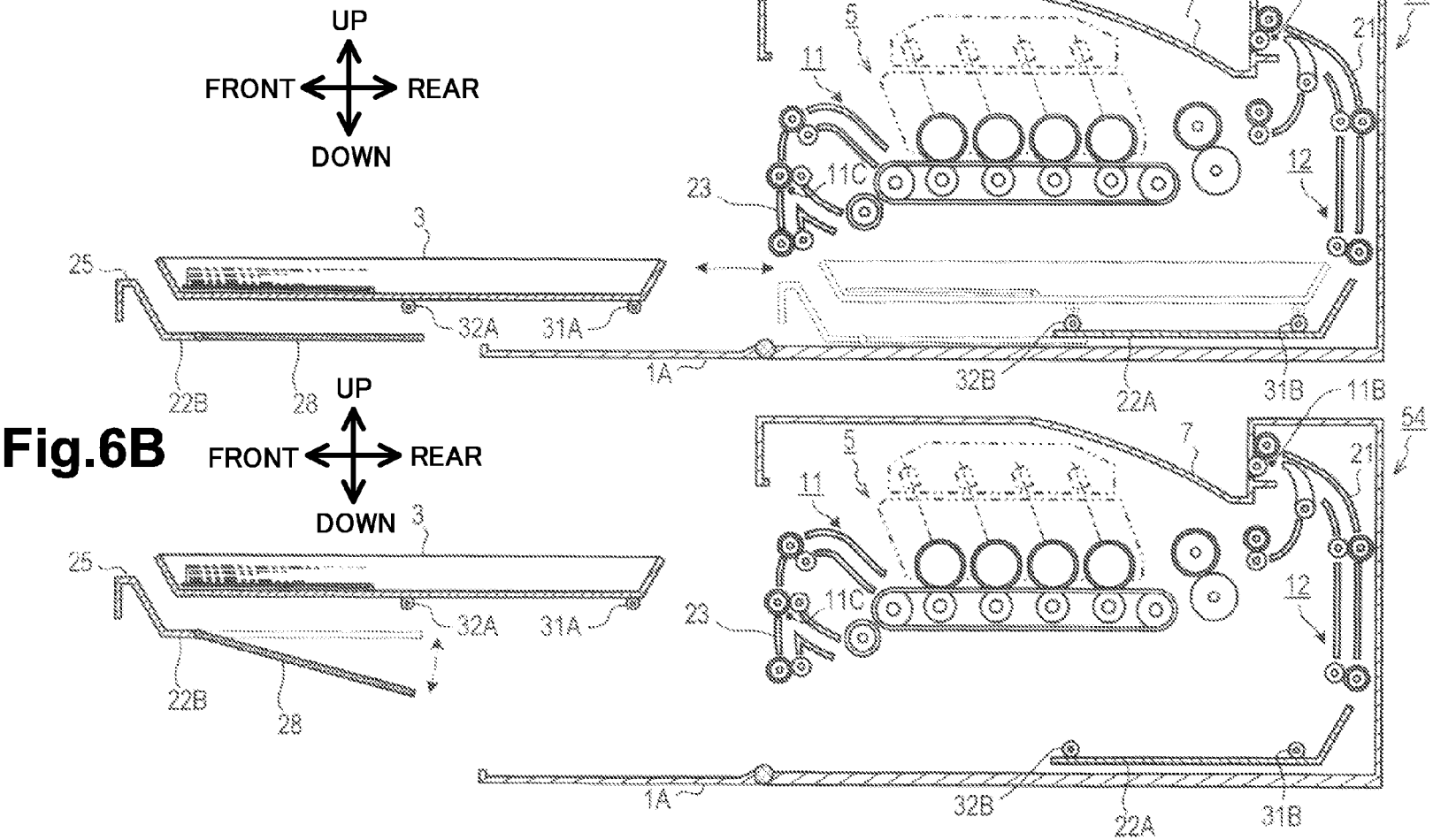
FIGS. 6A and 6B are a longitudinal sectional view showing a state in which a detachable unit of an image forming apparatus according to a fourth embodiment of the disclosure is detached, and a longitudinal sectional view showing a state in which a transport path of the image forming apparatus according to the fourth embodiment of the disclosure is opened, respectively.

Next, a fourth embodiment will be described. As shown in FIGS. 6A and 6B, in an image forming apparatus 54 illustrated as the fourth embodiment, as in the second and third embodiments, the portion corresponding to the intermediate section 22 illustrated in the first embodiment is made up of a first intermediate section 22A and a second intermediate section 22B.

Of the first intermediate section 22A and the second intermediate section 22B, the second intermediate section 22B is incorporated in the detachable unit 25, and is configured to be detached from the main body of the image forming apparatus 54 together with the feed tray 3. On the other hand, the first intermediate section 22A is secured on the image forming apparatus 54 body side, so that the first intermediate section 22A is left on the image forming apparatus 54 main body side even when the detachable unit 25 is detached from the main body of the image forming apparatus 54.

Among the rollers 31A, 31B, 32A, and 32B arranged on the first intermediate section 22A and the second intermediate section 22B, the rollers 31B and 32B are arranged on the image forming apparatus 54 main body side (first intermediate section 22A side), and the rollers 31A and 32A are arranged on the detachable unit 25 side (second intermediate section 22B side). It should be noted that as in the third embodiment, the second intermediate section 22B is provided with a movable section 28.

In the case of the image forming apparatus 54, the two roller pairs (the pair of rollers 31A and 31B and the pair of rollers 32A and 32B) are both separated by simply detaching the detachable unit 25. Therefore, in cases such as where the recording medium is stuck between each of the roller pairs, the recording medium can be removed easily by detaching the detachable unit 25, without any additional operation for separating each of the roller pairs.

Figures 7A, 7B:
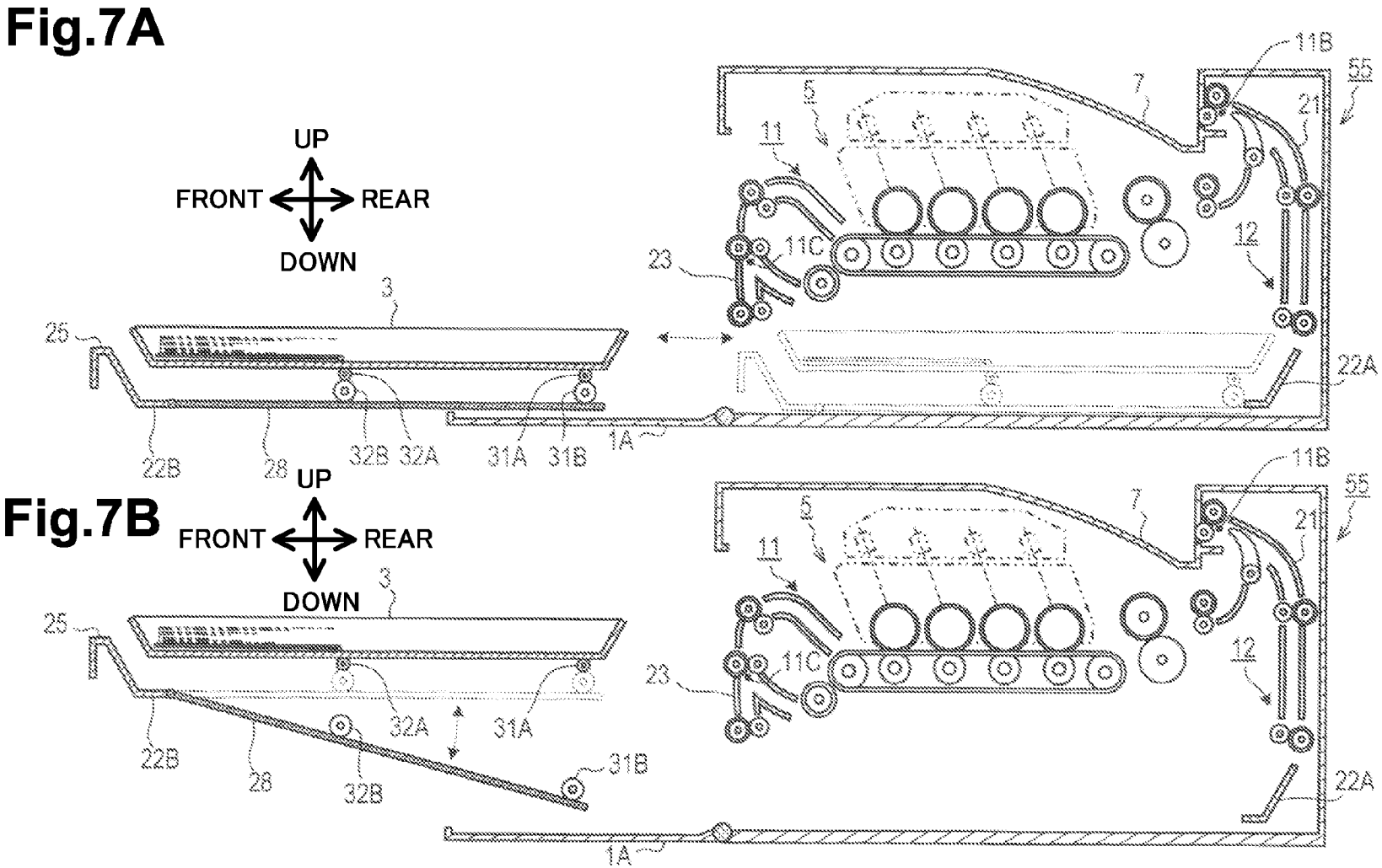
FIGS. 7A and 7B are a longitudinal sectional view showing a state in which a detachable unit of an image forming apparatus according to a fifth embodiment of the disclosure is detached, and a longitudinal sectional view showing a state in which a transport path of the image forming apparatus according to the fifth embodiment of the disclosure is opened, respectively.

Next, a fifth embodiment will be described. As shown in FIGS. 7A and 7B, in an image forming apparatus 55 illustrated as the fifth embodiment, as in the second to fourth embodiments, the portion corresponding to the intermediate section 22 illustrated in the first embodiment is made up of a first intermediate section 22A and a second intermediate section 22B.

It should be noted, however, that the rollers 31A, 31B, 32A, and 32B are all arranged on the detachable unit 25 side (second intermediate section 22B side). Also, the second intermediate section 22B is provided with a movable section 28.

In the case of the image forming apparatus 55, the two roller pairs (the pair of rollers 31A and 31B and the pair of rollers 32A and 32B) are both separated by simply opening the movable section 28. Therefore, in cases such as where the recording medium is stuck between each of the two roller pairs, by detaching the detachable unit 25 and opening the movable section 28, the recording medium can be removed easily through an operation done outside the main body of the image forming apparatus 55.

Figure 8A:
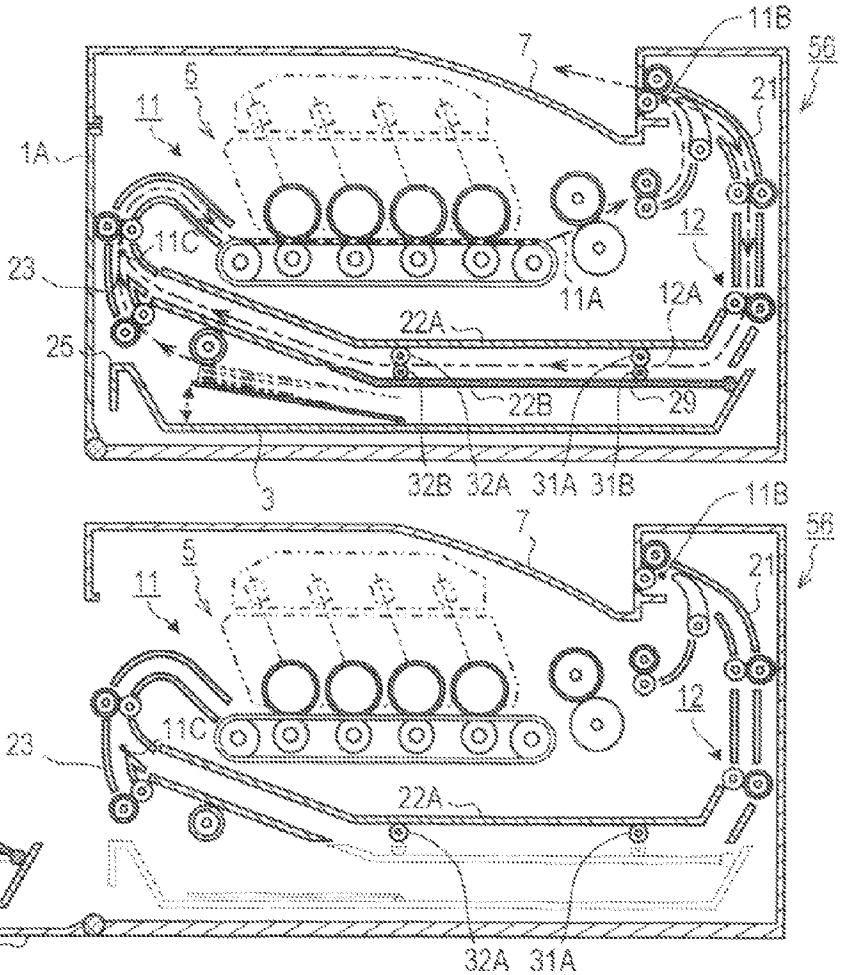
FIGS. 8A and 8B are a longitudinal sectional view showing the internal structure of an image forming apparatus according to a sixth embodiment of the disclosure, and a longitudinal sectional view showing a state in which a detachable unit of the image forming apparatus according to the sixth embodiment of the disclosure is detached and a feed tray is opened, respectively.
Figure 8A:
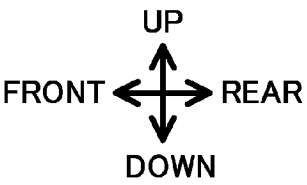
Figure 8B:
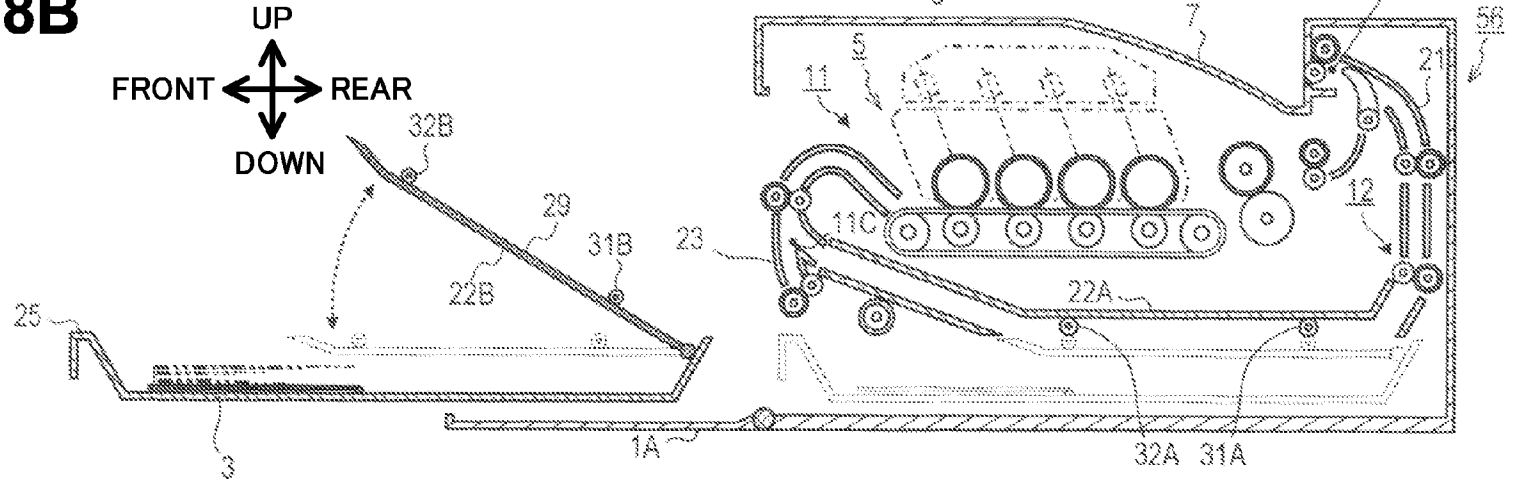

Next, a sixth embodiment will be described. As shown in FIGS. 8A and 8B, in an image forming apparatus 56 illustrated as the sixth embodiment, the portion corresponding to the intermediate section 22 illustrated in the first embodiment is made up of a first intermediate section 22A and a second intermediate section 22B. However, unlike in the first to fifth embodiments, the first intermediate section 22A and the second intermediate section 22B are placed above the feed tray 3. That is, the relative positions of the second transport path 12A and feed tray 3 are reversed from those in the first to fifth embodiments. As seen in FIGS. 8A and 8B the first intermediate section 22A may include an upper portion of the intermediate section 22 and the second intermediate section 22B includes a lower portion of the intermediate section 22.

Among the rollers 31A, 31B, 32A, and 32B arranged on the first intermediate section 22A and the second intermediate section 22B, the rollers 31A and 32A are arranged on the image forming apparatus 56 main body side (first intermediate section 22A side), and the rollers 31B and 32B are arranged on the detachable unit 25 side (second intermediate section 22B side). The second intermediate section 22B is provided with a movable section 29.

While the embodiments of the present disclosure have been described above, the present disclosure is not limited to each of the specific embodiments mentioned above but can be implemented in various other ways.

For example, the above-mentioned embodiments are directed to the case in which among the rollers arranged in the second transport path 12A, one or two pairs of rollers (rollers 31A, 31B, 32A, and 32B) are detached to the outside of the apparatus or separated. However, the number of pairs of rollers that are detached to the outside of the apparatus or separated in this way may be three or more.

While the above-mentioned embodiments are directed to the case of an image forming apparatus that forms an image by the electrophotographic technique, other recording technique (such as the inkjet technique and the thermal transfer technique) may be adopted as well. Also, while in the above-mentioned embodiments only the image forming function has been described as a function included in the image forming apparatus, the configuration according to the present disclosure can be adopted also for multifunction devices including functions other than the image forming function (such as an image reading function and a communication function).

What is claimed is:

1. An image forming apparatus comprising:

an apparatus body;

a feed tray comprising a support member that supports a recording medium in a form of a sheet placed on an upper side of the support member;

an image forming unit configured to form an image on the recording medium fed from the feed tray;

an eject section configured to eject the recording medium on which the image has been formed by the image forming unit;

a first transport mechanism forming a first transport path extending between the feed tray and the eject section via the image forming unit, the first transport mechanism configured to transport the recording medium along the first transport path; and a second transport mechanism comprising an intermediate section and a roller pair including a first roller attached to the support member and a second roller attached to at least one part of the intermediate section, the second transport mechanism forming a second transport path that extends between a branch position located downstream of the image forming unit on the first transport path and a merge position located upstream of the image forming unit on the first transport path and that branches off from the first transport path at the branch position and merges with the first transport path at the merge position, the second transport mechanism configured to transport the recording medium along the second transport path and reintroduce the recording medium to the first transport path from the merge position;

wherein the at least one part of the intermediate section and the feed tray are incorporated in a detachable unit that is configured to be attached to and detached from the apparatus body, and when the detachable unit is detached from the apparatus body, the support member is configured to be moved with respect to the at least one part of the intermediate section between a first position and a second position such that, when the support member is moved from the first position to the second position, the first roller is displaced together with the support member to separate from the second roller.

2. The image forming apparatus according to claim 1, wherein the at least one part of the intermediate section is provided directly below the support member.

3. The image forming apparatus according to claim 2, wherein, when the support member is in the second position, the support member exposes the at least one part of the intermediate section.

4. The image forming apparatus according to claim 3, wherein the support member is positioned in the first position during an image forming operation.

5. The image forming apparatus according to claim 3, wherein the roller pair pinches the recording medium when the recording medium is transported.

6. The image forming apparatus according to claim 5, further comprising a lock mechanism attached to the feed tray, wherein the support member is further configured to be moved between the first position and the second position along a movement path, and wherein at least one part of the lock mechanism protrudes from the feed tray and extends into the movement path of the support member such that the at least one part of the lock mechanism restricts displacement of the support member while keeping the first and second rollers of the roller pair in press contact with each other.

7. The image forming apparatus according to claim 1, wherein the roller pair includes:

a transport roller that is rotationally driven to transport the recording medium, and a pinch roller that rotates with the recording medium while pinching the recording medium with the transport roller.

8. The image forming apparatus according to claim 1, wherein a feed mechanism is incorporated in the detachable unit.

9. An image forming apparatus comprising:

an apparatus body;

a feed tray configured to accommodate a recording medium;

an image forming unit configured to form an image on the recording medium fed from the feed tray;

an eject section configured to eject the recording medium on which the image has been formed by the image forming unit;

a first transport mechanism forming a first transport path extending between the feed tray and the eject section via the image forming unit, the first transport mechanism configured to transport the recording medium along the first transport path; and a second transport mechanism forming a second transport path that extends between a branch position located downstream of the image forming unit on the first transport path and a merge position located upstream of the image forming unit on the first transport path and that branches off from the first transport path at the branch position and merges with the first transport path at the merge position, the second transport mechanism configured to transport the recording medium along the second transport path and reintroduce the recording medium to the first transport path from the merge position;

wherein the second transport mechanism includes an intermediate section and a roller pair including a first roller attached to a first part of the intermediate section and a second roller attached to a second part of the intermediate section, wherein the roller pair pinches the recording medium between the first roller and the second roller when the recording medium is transported along the second transport path, wherein the second part of the intermediate section and the feed tray are incorporated in a detachable unit that is configured to be attached to and detached from the apparatus body and the first part of the intermediate section is not incorporated in the detachable unit such that, when the detachable unit is detached from the apparatus body, the second roller is displaced together with the detachable unit and separates from the first roller, and wherein the second part of the intermediate section includes a moveable section which, when the detachable unit is detached from the apparatus body, is configured to swing with respect to the feed tray about a hinge between a first position and a second position, wherein the moveable section is positioned in the first position during an image forming operation, and wherein the second position provides access to the recording medium accommodated in the feed tray.

10. The image forming apparatus according to claim 9, wherein the first part of the intermediate section includes an upper portion of the intermediate section and the second part of the intermediate section includes a lower portion of the intermediate section.

11. The image forming apparatus according to claim 9, wherein the second roller is positioned on the moveable section.

12. An image forming apparatus comprising:

an apparatus body;

a feed tray comprising a support member that supports a recording medium in a form of a sheet placed on an upper side of the support member;

an image forming unit configured to form an image on the recording medium fed from the feed tray;

an eject section configured to eject the recording medium on which the image has been formed by the image forming unit;

a first transport mechanism forming a first transport path extending between the feed tray and the eject section via the image forming unit, the first transport mechanism configured to transport the recording medium along the first transport path; and a second transport mechanism comprising an intermediate section and a roller pair including a first roller attached to the support member and a second roller attached to at least one part of the intermediate section, the second transport mechanism forming a second transport path that extends between a branch position located downstream of the image forming unit on the first transport path and a merge position located upstream of the image forming unit on the first transport path and that branches off from the first transport path at the branch position and merges with the first transport path at the merge position, the second transport mechanism configured to transport the recording medium along the second transport path and reintroduce the recording medium to the first transport path from the merge position;

wherein the at least one part of the intermediate section and the feed tray are incorporated in a detachable unit that is configured to be attached to and detached from the apparatus body, wherein, when the detachable unit is attached to the apparatus body, the detachable unit is disposed within the apparatus body, wherein, when the detachable unit is detached from the apparatus body, the at least one part of the intermediate section is configured to be moved with respect to the support member between a first position and a second position such that, when the at least one part of the intermediate section is moved from the first position to the second position, the second roller is displaced together with the at least one part of the intermediate section to separate from the first roller; and wherein the at least one part of the intermediate section is provided directly below the support member.

13. The image forming apparatus according to claim 12, wherein the first roller and the second roller are configured to be exposed to an outside of the detachable unit when the detachable unit is detached from the apparatus body.

14. The image forming apparatus according to claim 12, wherein, when the at least one part of the intermediate section is in the second position, the at least one part of the intermediate section exposes the roller pair.

15. The image forming apparatus according to claim 14, wherein the at least one part of the intermediate section is positioned in the first position during an image forming operation.

16. The image forming apparatus according to claim 14, wherein the roller pair pinches the recording medium when the recording medium is transported.

17. The image forming apparatus according to claim 12, wherein the roller pair includes:

a transport roller that is rotationally driven to transport the recording medium, and a pinch roller that rotates with the recording medium while pinching the recording medium with the transport roller.

18. The image forming apparatus according to claim 12, wherein a feed mechanism is incorporated in the detachable unit.

19. An image forming apparatus comprising:

an apparatus body;

a feed tray comprising a support member that supports a recording medium in a form of a sheet placed on an upper side of the support member;

an image forming unit configured to form an image on the recording medium fed from the feed tray;

an eject section configured to eject the recording medium on which the image has been formed by the image forming unit;

a first transport mechanism forming a first transport path extending between the feed tray and the eject section via the image forming unit, the first transport mechanism configured to transport the recording medium along the first transport path; and a second transport mechanism forming a second transport path that extends between a branch position located downstream of the image forming unit on the first transport path and a merge position located upstream of the image forming unit on the first transport path and that branches off from the first transport path at the branch position and merges with the first transport path at the merge position, the second transport mechanism configured to transport the recording medium along the second transport path and reintroduce the recording medium to the first transport path from the merge position, wherein the second transport mechanism comprises:

an intermediate section provided directly below the support member including a first intermediate section portion and a second intermediate section portion;

a first roller pair disposed at the first intermediate section portion and including a first roller and a second roller configured to pinch therebetween the recording medium when the recording medium is transported along the second transport path; and a second roller pair disposed at the second intermediate section portion and including a third roller and a fourth roller configured to pinch therebetween the recording medium when the recording medium is transported along the second transport path, wherein the second intermediate section portion, the second roller pair, and the feed tray are incorporated in a detachable unit that is configured to be attached to and detached from the apparatus body, wherein, when the detachable unit is attached to the apparatus body, the detachable unit is disposed within the apparatus body, and wherein, when the detachable unit is detached from the apparatus body, the first intermediate section and the first roller pair remain within the apparatus body.

* * * * *